US006890149B2

(12) United States Patent
Metz et al.

(10) Patent No.: US 6,890,149 B2
(45) Date of Patent: May 10, 2005

(54) LAMINAR FLOW AIR MOVER

(76) Inventors: Donald Metz, 6124 Poolsbrook Rd., Kirkville, NY (US) 13082; David Martini, 6943 Shannon Way, Liverpool, NY (US) 13088

( * ) Notice: Subject to any disclaimer, the term of this patent is extended or adjusted under 35 U.S.C. 154(b) by 92 days.

(21) Appl. No.: 10/388,511

(22) Filed: Mar. 17, 2003

(65) Prior Publication Data

US 2003/0228218 A1 Dec. 11, 2003

Related U.S. Application Data

(63) Continuation-in-part of application No. 10/162,196, filed on Jun. 5, 2002, now Pat. No. 6,692,229.

(51) Int. Cl.[7] ..... F04D 29/40

(52) U.S. Cl. ..... 415/126; 415/211.2; 415/214.1; 416/244 R; 285/184

(58) Field of Search ..... 415/126, 206, 415/211.2, 214.1, 221, 224; 416/244 R; 285/184, 319

(56) References Cited

U.S. PATENT DOCUMENTS

| | | | | | |
|---|---|---|---|---|---|
| 1,618,155 | A | * | 2/1927 | Thomas, Jr. et al. | 406/144 |
| 4,291,671 | A | * | 9/1981 | Senne | 126/292 |
| 4,730,790 | A | * | 3/1988 | Williams | 241/81 |
| 5,299,737 | A | * | 4/1994 | McGinnis et al. | 239/77 |
| 5,667,329 | A | * | 9/1997 | Yoder, Jr. | 403/327 |
| 6,517,015 | B2 | * | 2/2003 | Rowley, Jr. | 241/5 |

* cited by examiner

*Primary Examiner*—Ninh H. Nguyen
(74) *Attorney, Agent, or Firm*—Sughrue Mion, PLLC

(57) ABSTRACT

A laminar flow air mover includes a cylindrical fan having an outlet opening connected to a conduit system. The conduit system includes a first portion connected to the outlet portion of said centrifugal fan and an outlet portion detachably connected to the first portion by a reusable breakaway connection. A baffle plate is pivotably mounted in the outlet of said outlet portion and extends transversely of said outlet portion to direct a coherent flow of air for a substantial distance in the desired direction.

2 Claims, 4 Drawing Sheets

LAMINAR FLOW AIR MOVER

The present application is a continuation-in-part of application Ser. No. 10/162,196 filed Jun. 5, 2002 now U.S. Pat. No. 6,692,229.

BACKGROUND OF THE INVENTION

The present invention is directed to a laminar flow air mover and more specifically to a centrifugal blower having forwardly curved blades inclined in the direction of the rotation of the impeller and having a conduit secured to the outlet of the centrifugal blower. A transversely extending baffle having a profile smaller than the outlet of the conduit is pivotally mounted in the outlet end of the conduit in such a manner so as to direct the entire flow of air from the centrifugal blower to any location in a trailer. The laminar air flow created by the assembly creates a coherent flow of air which is capable of moving substantial distances from the outlet of the conduit before dissipating.

Prior to the present invention radial fans were used to direct air into a trailer but such fans failed to create a coherent flow of air which would travel any substantial distance. Such fans are typically low pressure fans wherein the air flow dissipates quickly in a radial manner.

SUMMARY OF THE INVENTION

The present invention provides a new and improved laminar flow air mover assembly which is capable of providing a coherent air flow for a distance of approximately 55 feet. Thus the laminar air flow mover is suitable for directing a coherent flow of air the entire length of the largest road trailer available today to provide a significantly improved air cooling or heating system for the trailer. The entire laminar air flow mover assembly is mountable within a building having a loading platform adjacent the door of the building aligned with the open rear end of a trailer. The air mover assembly is adjustably mounted on a support adjacent the door opening so as to locate the outlet of the conduit in alignment with the door opening of the building to direct the flow of air into the trailer.

The present invention provides a laminar flow air mover having a centrifugal blower with forwardly curved blades inclined in the direction of rotation of the impeller and having a conduit secured to the outlet of the centrifugal blower. A baffle is pivotably mounted in the outlet opening of the conduit for directing the flow of air to any location in a trailer. The laminar air flow created by the assembly creates a coherent flow of air which is capable of moving substantial distances from the outlet of the conduit before dissipating.

DETAILED DESCRIPTION OF THE INVENTION

Figure 1:
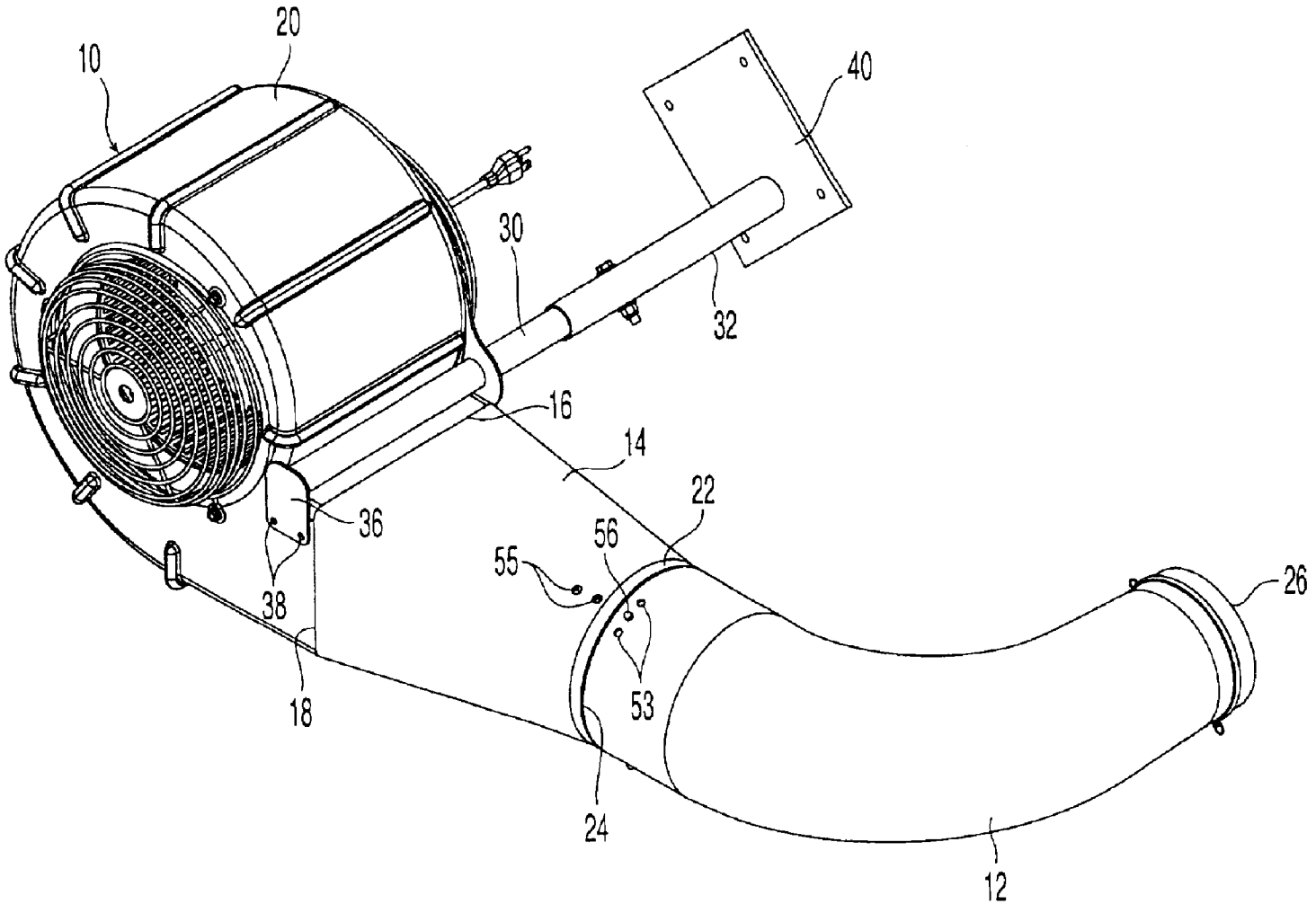
FIG. 1 is a perspective view of the laminar flow air mover assembly.
Figure 2:
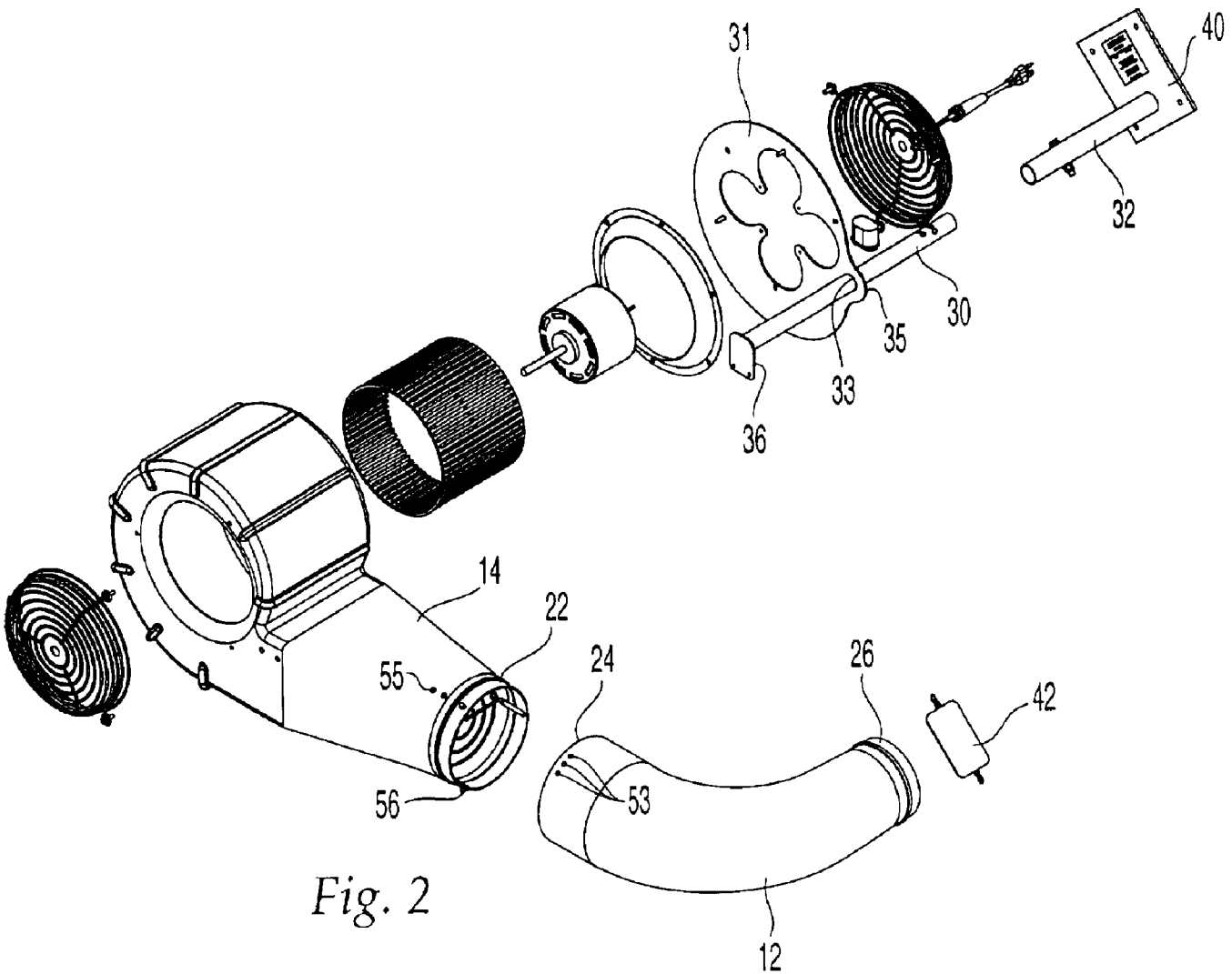
FIG. 2 is an exploded view of the assembly shown in FIG. 1.
Figure 3:
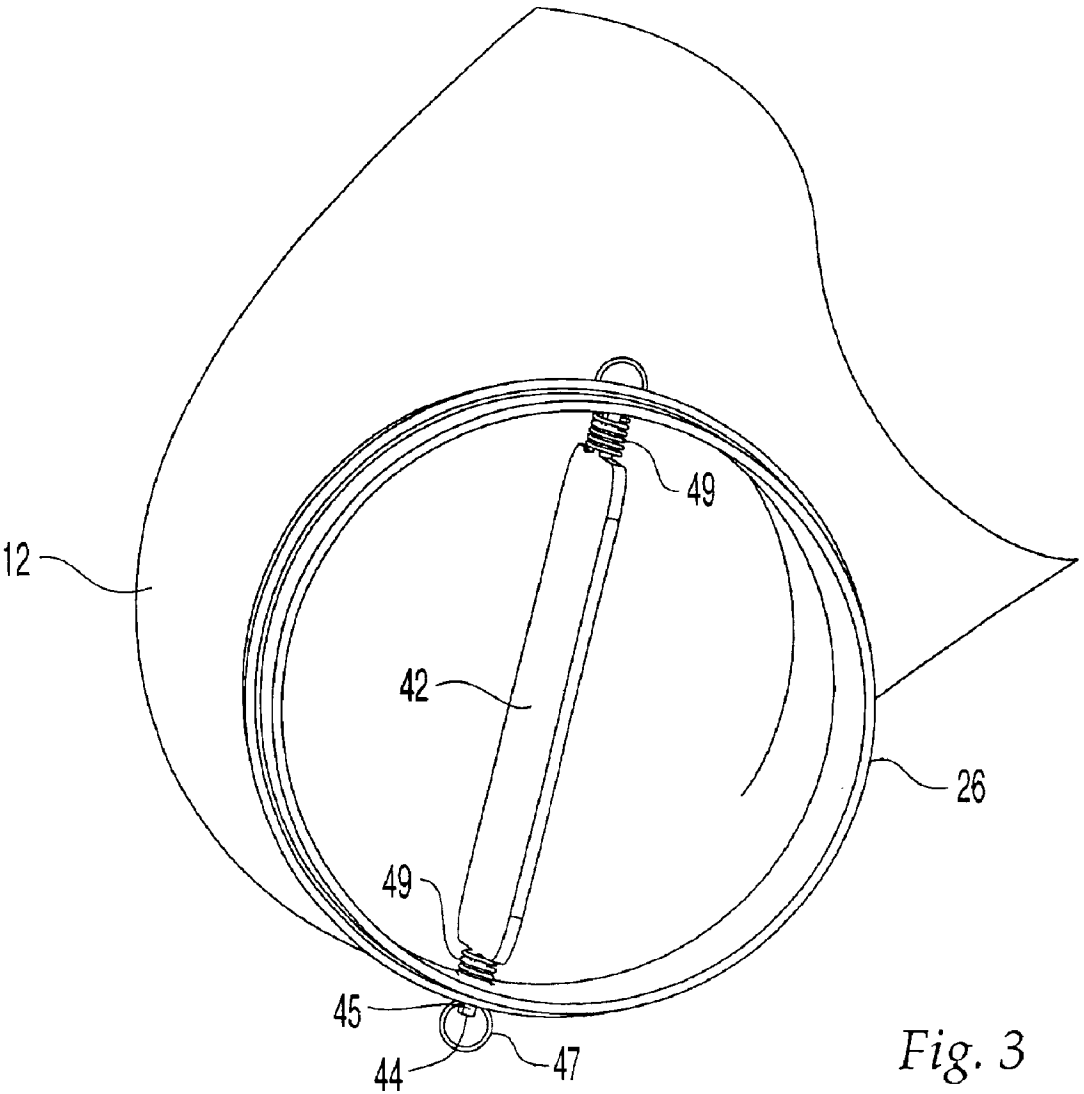
FIG. 3 is an enlarged partial view of the outlet end of the conduit with the baffle pivotably mounted therein.

The laminar flow air mover assembly shown in FIG. 1 is comprised of a centrifugal blower (10) having an outlet pipe connected thereto by means of an intermediate adapter section (14). The intermediate adapter section has a rectangular configuration adjacent the inlet end (16) which mates with the rectangular outlet opening of the centrifugal blower housing (20). The intermediate connector (14) tapers gradually to a smaller outlet opening (22) having a circular configuration. The total area of the outlet opening (22) is substantially less than the rectangular inlet opening (16).

Figure 4:
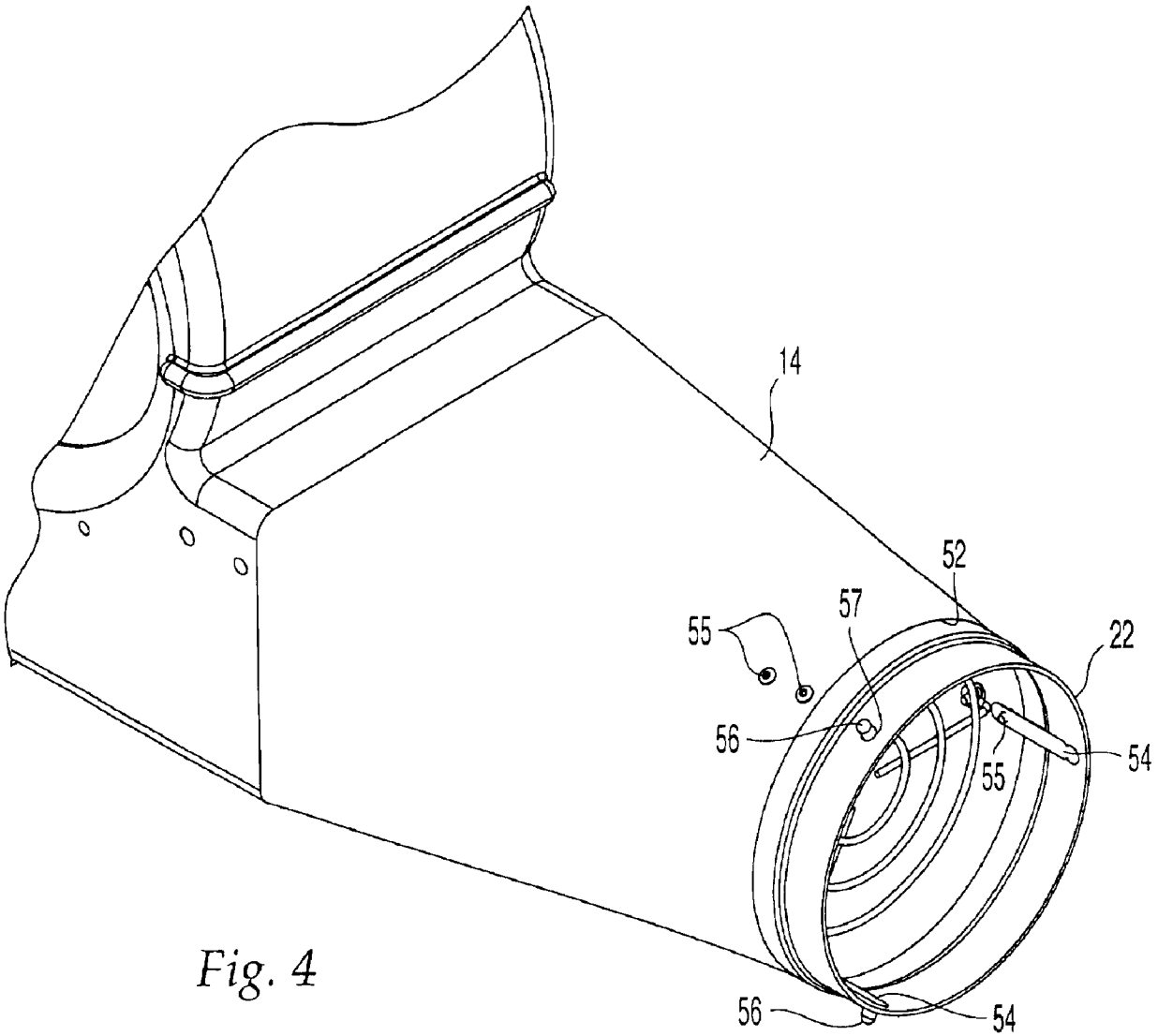
FIG. 4 is an enlarged detail of the outlet opening of the intermediate pipe showing the breakaway connection.

The outlet pipe (12) has an elbow-like configuration with the inlet opening (24) being larger than the outlet opening (26). The inlet opening (24) of the outlet pipe (12) is connected to the outlet opening (22) of the intermediate pipe (14) by means of a breakaway connection. The intermediate pipe (14) is provided with a stepped recess (52) adjacent the outlet end (22) for receiving the inlet opening (24) of the outlet pipe (12). The stepped recess (52) will limit the amount of overlap between the two pipes. The stepped recess (52) is provided with three equally spaced holes (57) only one of which is shown in FIG. 4. Three elongated leaf springs (54) are mounted in equally spaced relationship in the interior of the outlet end of the intermediate pipe (14). The leaf springs (54), only two of which are shown in FIG. 4, are secured at one end by rivets (55). The opposite end of each leaf spring has a protruding pin (56) mounted on the end thereof in alignment with each hole (57) so that the pin (56) protrudes outwardly through the opening (53). Three sets of three holes (53) are formed in the inlet end (24) of the outlet pipe in equally spaced relationship to align with the holes (57) in the outlet opening of the intermediate pipe. The outlet (12) cam be adjustably rotated relative to the intermediate pipe (14) to three different portions defined by the holes (53). When the pipes are assembled as shown in FIG. 1 the pins (56) will protrude into the openings (53) to connect the outlet pipe to the intermediate pipe. If undue stress is placed on the outlet pipe (12) the pins (56) will readily pop out of the openings (53) in the intermediate pipe. Thus the outlet conduit (18) will readily separate from the intermediate conduit (14) upon impact to the outlet conduit (12) by a fork-lift truck or the like passing through the door. The outlet conduit can readily be snap-engaged again.

Since the diameter of the outlet opening (26) is less than the diameter of the inlet opening (24) and since the intermediate pipe (14) tapers downwardly in a similar manner, a certain degree of back pressure is provided to the centrifugal blower. It is well known that a centrifugal blower needs a certain amount of back pressure in order to operate more efficiently.

A mounting assembly for the centrifugal blower is comprised of a first smaller diameter pipe (30) and a larger diameter pipe (32) which are telescopically mounted with respect to each other. The first pipe (30) extends through an aperture (33) in a protruding portion (35) of the inlet plate (31) which is mounted on one side of the centrifugal blower housing mounting plate (36) is secured at one end of the first pipe (30) which in turn is secured to the centrifugal blower housing (10) adjacent the outlet opening thereof by means of screws or rivets (38). A mounting plate (40) is secured to the end of the larger diameter pipe (32) opposite the end which is disposed in a telescopic relationship with the pipe (30). An adjustable connection arrangement is provided between the telescopic pipes (30, 32) similar to that disclosed in the parent application Ser. No. 10/162,196. The mounting plate (40) may be secured to the wall of a warehouse adjacent the loading platform door by any suitable means such as screws.

A baffle plate (42) is pivotably mounted in the outlet opening (26) by integral pins (44) at opposite ends of the plate (42). A transverse through hole (45) is formed in each end of the pin which protrudes outwardly of the pipe (12). A split ring (47) can be inserted through each hole (45) to prevent withdrawal of the pin (44) from the opening. The baffle plate (42) may be manually pivoted so as to divert the flow of air coming from the outlet pipe (12) in the desired direction. A pair of coil springs (49) are mounted on each pin (44) respectively between the baffle plate and the interior surface of the outlet pipe. This will provide suitable frictional resistance to the turning of the baffle (42) so that the baffle plate 42 will remain in the desired position after pivoting.

By using a centrifugal blower in combination with an outlet pipe of gradually diminishing diameter and having a pivoted baffle in the outlet end thereof makes it possible to provide a coherent flow of air for a great distance in the desired direction.

What is claimed is:

1. A laminar flow air mover comprising a centrifugal blower having an outlet and a conduit system connected to said outlet of the centrifugal blower wherein the conduit system has an outlet and further comprising a mounting bracket having first and second telescopically movable first and second pipes, said first pipe being connected to said centrifugal blower and the second pipe being connected to a mounting bracket for mounting the air mover on a wall adjacent an opening wherein said first pipe is provided with a plurality of circumferentially disposed apertures and said second pipe is provided with a plurality of longitudinally disposed apertures and a pin adapted to extend through aligned apertures in said pipes to adjust the length and angular orientation of the pipes relative to each other.

2. A laminar flow air mover comprising a centrifugal blower having an outlet and a conduit system connected to said outlet of the centrifugal blower wherein the conduit system has an outlet, wherein said conduit system is comprised of a first portion connected to said outlet of the centrifugal blower and an elbow portion detachably connected to the first portion at one end and wherein the first portion of said conduit system has a cylindrical portion at an outlet end thereof having a plurality of equally spaced openings therein, a plurality of leaf springs each mounted at one end thereof inside said first portion adjacent each opening, a pin mounted at an opposite end of each leaf spring and protruding outwardly through each opening and a plurality of equally spaced openings extending about an inlet end of said elbow portion in alignment with said openings in said first portion for detachably receiving said pins therein respectively.

* * * * *